US010052599B2

(12) United States Patent
Connealy et al.

(10) Patent No.: US 10,052,599 B2
(45) Date of Patent: Aug. 21, 2018

(54) MIXING CHAIN AGITATOR

(71) Applicant: Mixer Fitness, LLC, Lincoln, NE (US)

(72) Inventors: Devan Connealy, Lincoln, NE (US); Keegan Borer, Lincoln, NE (US)

(73) Assignee: miXer Fitness, LLC, Lincoln, NE (US)

( * ) Notice: Subject to any disclaimer, the term of this patent is extended or adjusted under 35 U.S.C. 154(b) by 537 days.

(21) Appl. No.: 14/674,893

(22) Filed: Mar. 31, 2015

(65) Prior Publication Data

US 2016/0288068 A1 Oct. 6, 2016

(51) Int. Cl.
*B01F 15/00* (2006.01)
*B01F 13/00* (2006.01)

(52) U.S. Cl.
CPC ..... *B01F 13/005* (2013.01); *B01F 15/00512* (2013.01)

(58) Field of Classification Search
CPC ..... B01F 13/005; B01F 15/00512; B01F 115/00512; F16G 13/14
See application file for complete search history.

(56) References Cited

U.S. PATENT DOCUMENTS 2,110,474 A * 3/1938 Reyburn ..... B60C 27/08 152/245
2,353,939 A * 7/1944 Staats ..... F16G 13/14 59/85
3,507,112 A * 4/1970 Nelson ..... F16G 13/14 249/57

* cited by examiner

*Primary Examiner* — Anshu Bhatia
(74) *Attorney, Agent, or Firm* — Y. Kamaal Patterson

(57) ABSTRACT

An apparatus and process are provided for mixing of liquid, powder, and other ingredients using a mixing chain agitator. The mixing chain agitator is comprised of a plurality of links where each link comprises crossbars to create divisions for liquids, powders, and other ingredients to pass through during the mixing action. The plurality of links may be interlinked according to the embodiments disclosed.

3 Claims, 5 Drawing Sheets

MIXING CHAIN AGITATOR

BACKGROUND

Agitators are commonly used for mixing liquids, powders, and other ingredients placed in containers. An agitator is often designed to improve or optimize the mixing action applied to a container. The mixing action causes the agitator to be displaced within the container. The displacement of the agitator can disperse the liquid(s), powder(s), and/or ingredient(s) to create a mixture in the container. The dispersion and mixture of the liquid(s), powder(s), and/or ingredient(s) prevent settling in an unmixed state.

Dietary supplements are often consumed as a mixture of a powder (e.g., whey protein powder) and/or other ingredient (e.g., peanut butter) mixed with a liquid (e.g., water). Other beverages may also involve the mixture of a powder and/or other ingredients being mixed with a liquid, such as baby formula. Without proper mixing or agitation, a mixture may result in a non-homogenous composition with clumps formed by aggregations of powder(s) and/or other ingredient(s). These clumps may settle at the bottom of the container, remain suspended within the liquid, or float to the top of the liquid within the container. Without proper mixing or agitation, powders and/or other ingredients may also stick to the side of the container and remain undispersed and unmixed with the liquid in the container.

SUMMARY

The present invention is a mixing chain agitator, which is an apparatus for agitating a liquid mixture in a container. In some embodiments the mixing chain agitator comprises a plurality of links with divisions through which liquids, powders, and other ingredients may pass. Accordingly, it is an object of the present disclosure to provide an apparatus for mixing powders and/or other ingredients with a liquid in a container. It is another object of the present disclosure to provide an apparatus for dispersing and reducing the occurrence of clumps of powders and/or other ingredients within a liquid in a container.

It is to be understood that both the foregoing general description and the following detailed description are exemplary and explanatory only and are not necessarily restrictive of the disclosure as claimed. The accompanying drawings, which are incorporated in and constitute a part of the specification, illustrate embodiments of the disclosure and together with the general description, serve to explain the principles of the disclosure.

BRIEF DESCRIPTION OF THE DRAWINGS

The numerous advantages of the present disclosure may be better understood by those skilled in the art by reference to the accompanying figures in which.

DETAILED DESCRIPTION

Figure 1A:
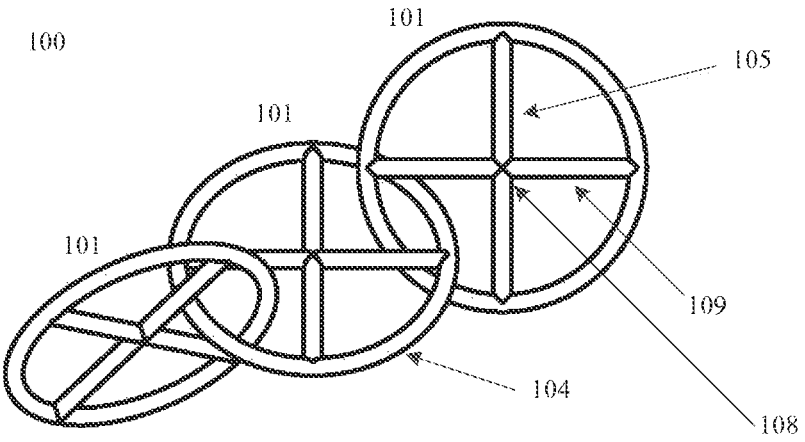
FIG. 1A is a perspective view illustrating an exemplary embodiment of a mixing chain agitator with a plurality of links.
Figure 1B:
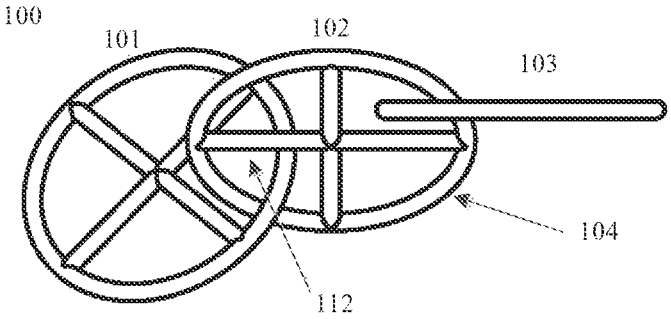
FIG. 1B is another perspective view illustrating an exemplary embodiment of a mixing chain agitator with a plurality of links.
Figure 2A:
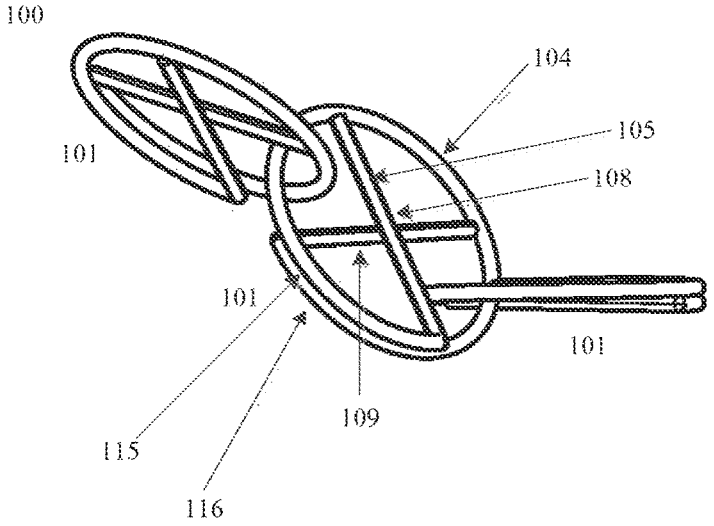
FIG. 2A is a perspective view illustrating another exemplary embodiment of a mixing chain agitator with a plurality of links.

Referring to FIGS. 1A and 2A, there are embodiments of the present disclosure for a mixing chain agitator 100 with a plurality of links 101. In these exemplary embodiments of the present disclosure, each link is formed by a shaped framework 104. In the exemplary embodiments of FIGS. 1A and 2A, the link 101 has a shaped framework 104 in the form of a circle or ring. In other exemplary embodiments, a link 101 may have a shaped framework 104 in a different shape (e.g., oval, triangle, rectangle, square, pentagon, etc). The shaped framework 104 of a link 101 will have one or more outer edges that form the shape of the link. The exemplary embodiments of the present disclosure, as seen in FIGS. 1A and 2A, present the mixing chain agitator 100 with three links. In other exemplary embodiments, the mixing chain agitator may comprise any number of links (e.g., five links).

The plurality of links 101 to the mixing chain agitator 100 may be composed of a number of different materials. In one embodiment of the present disclosure, a link is made of low-corrosion metal, in other embodiments of the present disclosure, a link 101 is made of a plastic material. In other embodiments of the present disclosure, the material selected for a link 101 is based on elastic deformation characteristics to affect the mixing process. In other embodiments of the present disclosure, the material selected for a link 101 is based on weight (or mass) characteristics to affect the mixing process.

Figure 3A:
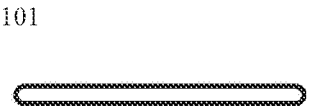
FIG. 3A is a side sectional view illustrating an exemplary embodiment of a single link from a mixing chain agitator.
Figure 3B:
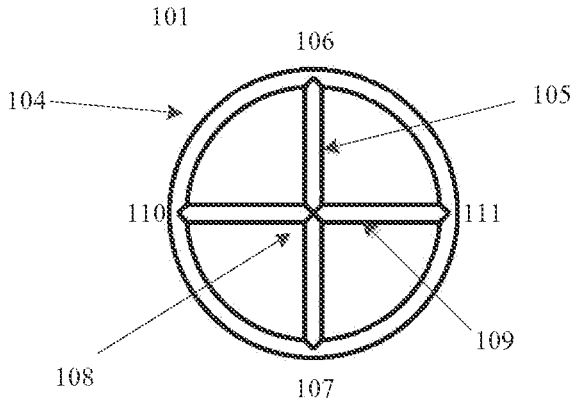
FIG. 3B is a top sectional view illustrating an exemplary embodiment of a single link from a mixing chain agitator.
Figure 4A:
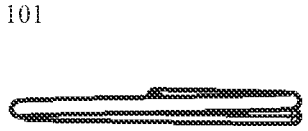
FIG. 4A is a side sectional view illustrating another exemplary embodiment of a single link from a mixing chain agitator.
Figure 4B:
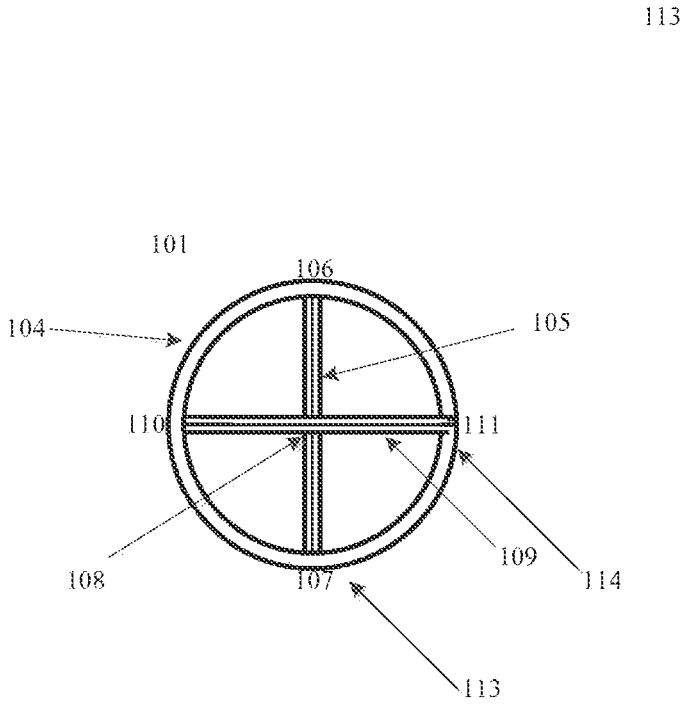
FIG. 4B is a top sectional view illustrating another exemplary embodiment of a single link from a mixing chain agitator.

Referring to FIGS. 3B and 4B, a link 101 may comprise a first crossbar 105. The first crossbar 105 traverses a first distance across the link from a first end 106 on the shaped framework 104 of the link 101 to a second end 107 on the shaped framework 104 of the link 101. In an exemplary embodiment of the present disclosure, the first distance is a diameter of the link 101, passing through a center 108 of the link 101. Continuing the exemplary embodiment, a link 101 may also comprise a second crossbar 109. The second crossbar 109 traverses a second distance across the link from a third end 110 on the shaped framework 104 of the link 101 to a fourth end 111 on the shaped framework 104 of the link 101. In an exemplary embodiment of the present disclosure, the second distance also measures the diameter of the link 101 passing through the center 108 of the link 101, whereby the second crossbar 109 intersects the first crossbar 105 at the center 108 of the link 101.

In other embodiments of the present disclosure, a link 101 may comprise three or more crossbars traversing the diameter of the link 101 and intersecting each other at the center 108 of the link 101 (e.g., a spoke and wheel configuration). There may be a plurality of crossbars that parallel each other in such exemplary embodiments. In other embodiments of the present disclosure, there may be a plurality of crossbars that parallel each other and one or more crossbars that intersect the parallel plurality of crossbars. In such embodiments, the intersections of the crossbars may form angles to one another, such as the perpendicular angles seen in FIGS. 3B and 4B formed by the first crossbar 105 and the second crossbar 109.

A first link 101 may interlink (or chain) with a second link 102 through a variety of means. For example, the first link 101 may interlink with the second link 102 through a closeable separation in the first link 101 for a contiguous segment of the second link 102 to pass through into a division 112 of the first link 101. In one embodiment of the present disclosure, the closeable separation is created in a first link 101 configured to include a hinged gate, similar to a gate used by a carabiner, along the link's shaped framework 104 that pivots in a circumferential direction to an open position. The hinged gate of the first link 104 may open to permit a contiguous segment of a second link 102 to pass through the shaped framework 104 of that first link 101. After the contiguous segment of the second link 102 passes through the open hinged gate, the hinged gate may be closed in order to complete the interlink between the first link 101 and the second link 102. In one embodiment of the present disclosure, the hinged gate may be spring-loaded such that, when a lever, button, or other mechanism is engaged, the hinged gate opens due to a springing force acting through the hinged gate. Alternatively, or in combination, another embodiment of the present disclosure enables the hinged gate to be reverse spring-loaded such that, when a force that opens the hinged gate is removed, the hinged gate closes due to a springing force acting through the hinged gate.

Figure 2B:
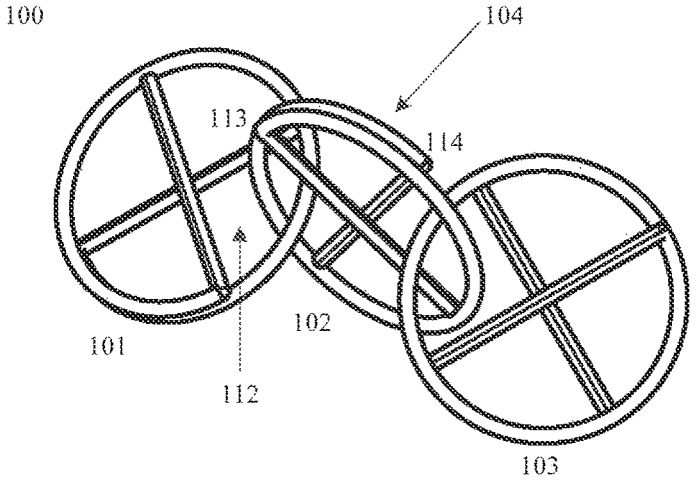
FIG. 2B is another perspective view illustrating another exemplary embodiment of a mixing chain agitator with a plurality of links.

Referring to FIGS. 2B and 49, in another embodiment of the present disclosure, a shaped framework 104 of a first link 101 is configured to include two overlapping segments, a top segment and a bottom segment. In the embodiment where the shaped framework 104 is circular, the top segment overlaps the bottom segment by a circumferential length and by a horizontal width to form a closed configuration of the shaped framework 104. For purposes of the present disclosure, "circumferential" is a rotational direction about a circular shaped framework 104; alternatively, "circumferential" is a direction along a side to a non-circular shaped framework 104. Therefore, a "circumferential length" is a length spanning at least a portion of the circumference of the circular shaped framework 104 (or the side of the non-circular shaped framework 104, if the link 101 is non-circular (e.g., a square)). For purposes of the present disclosure, "horizontal" is a direction perpendicular to and through a side of a shaped framework 104. Therefore, a "horizontal width" is a length spanning at least a portion of the width of the shaped framework 104.

A first link 101 configured to include two overlapping segments would be comprised of an elastic material such that the top segment and the bottom segment can be displaced from and restored to their resting positions of overlap. For purposes herein, the restoring force of the elastic material is a force exerted by the material in response to stress applied to the material—that is, the material is not permanently strained or deformed by a substantial amount due to the stress. When force is applied (e.g., in opposite axial and/or horizontal directions to the top segment and the bottom segment), an opening is created in the first link 101 to permit a segment of a second link 102 to pass through the shaped framework 104 of the first link 101. After the segment of the second link 102 passes through the opening, the applied force may be removed (or stopped) in order for the top segment and bottom segment to restore to their resting positions of overlap and to complete the interlink between the first link 101 and the second link 102.

Referring to FIGS. 2B, 4A and 4B, a link 101 may be configured to comprise a first crossbar 105 and a second crossbar 109 using a single piece of material (e.g., steel). The first crossbar 105 traverses a first distance across the link from a first bend 113 on the shaped framework 104 of the link to a first abutting end on the shaped framework 104 of the link. In a preferred embodiment, the first crossbar 105 traverses the diameter of the link, passing through or substantially proximal to the center 108 of the link. The second crossbar 109 traverses a second distance across the link from a second bend 114 on the shaped framework 104 of the link to a second abutting end on the shaped framework 104 of the link. In a preferred embodiment, the second crossbar 109 traverses the diameter of the link, passing through or substantially proximal to the center 108 of the link and overlapping (or intersecting) with the first crossbar 105 at the center 108.

As described above for the embodiment of FIGS. 2B and 4B, there may be an overlap of a first segment 115 on the shaped framework 104 of the link with a second segment 116 on the shaped framework 104 of the link. As seen in the exemplary embodiment, the first segment 115 and the second segment 116 may have lengths equal (or approximately equal) to one-fourth of the circumference to the circular shaped framework 104 to the link.

In accordance with embodiments of the present disclosure, the single piece of material may be formed into a link using a bending force applied during manufacturing. For example, a single piece of steel could be bent into the circular shaped framework 104 with the first crossbar 105 formed from a first bend and the second crossbar 109 formed from a second bend.

In accordance with other embodiments of the present disclosure, the bent material may be formed using a mold during manufacturing. For example, a single mold may comprise a first layer including the first bend forming the first crossbar 105, and the single mold may transition to a second layer including the second bend forming the second crossbar, where the second layer overlaps (or overlays) at least a portion of the first layer. The first bend in such a single mold may be formed at an end of the first segment 115 and the second bend may be formed at an end of the second segment 116, where there is an approximately 90 degree difference between where each bend starts along the link when looking from an overhead perspective or view.

The first segment 115 and the second segment 116 to the link 101, as seen in FIG. 2A, may overlap in a contacting manner. The material comprising the link 101 may be rigid in order to maintain the contact between the first segment 115 and the second segment 116. However, the material comprising the link 101 also may be sufficiently elastic to allow an applied force to create a separation between the overlapping first segment 115 and second segment 116 (e.g., by displacing the first segment 115 and second segment 116 in opposite axial and/or horizontal directions). The separation may be enough to enable a segment of a second link to pass through the separation to interlink (or chain) the link 101 and the second link together. The elasticity of the material to the link 101 would trigger restoring forces to close the separation and restore the contact between the first segment 115 and the second segment 116 after removing the applied force that created the separation.

Referring to FIGS. 2A and 3A, the intersection or overlapping of the first crossbar 105 and the second crossbar 109 forms a plurality of divisions (e.g., division 112) for the mixing chain agitator 100. A division 112 may outline a void that allows for a flux of liquid and powder (and/or other ingredients) through the division.

Figure 5:
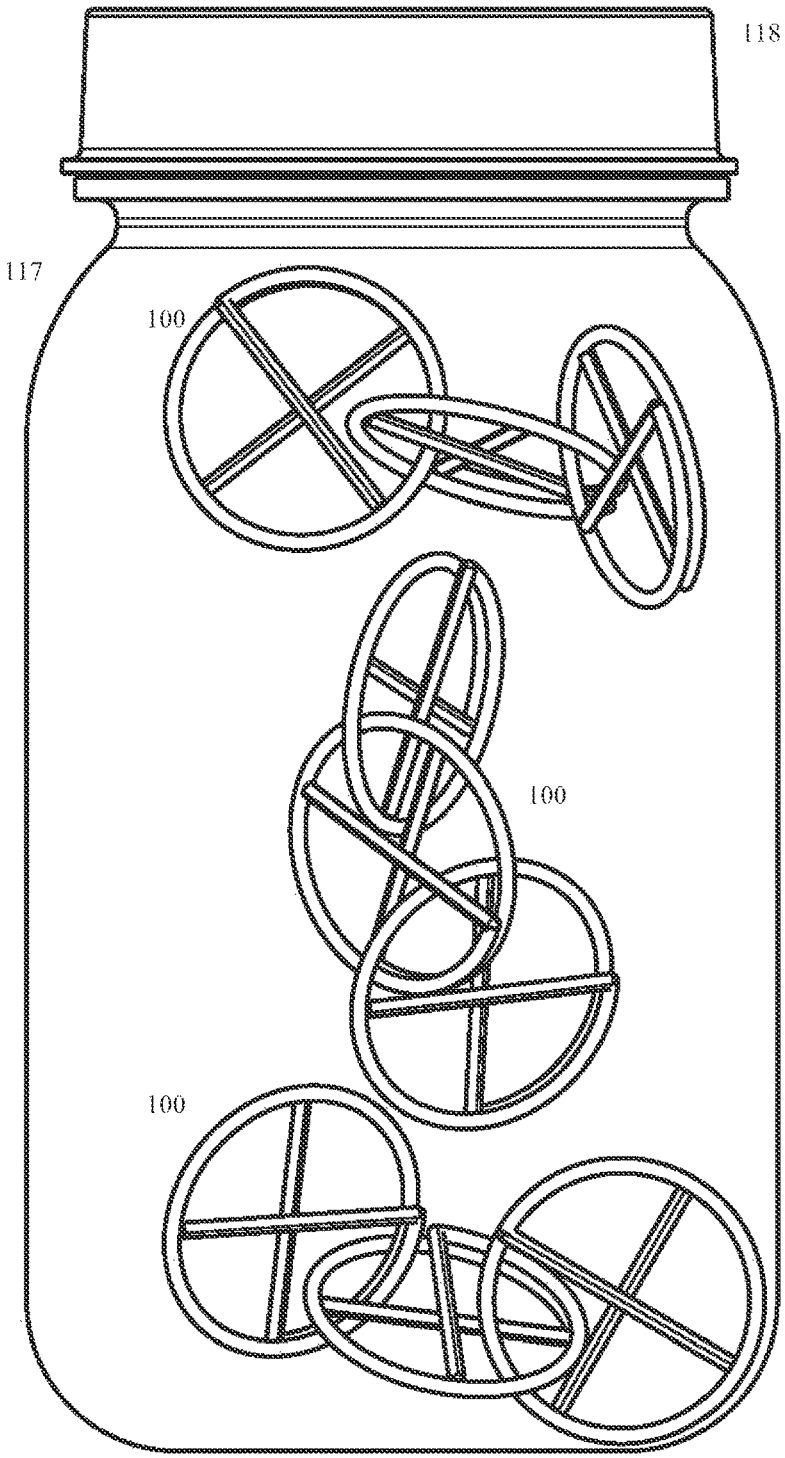
FIG. 5 is a perspective view of a mixing chain agitator of the present invention moving through the enclosable space of a container.

Referring to FIG. 5, the flux, or flow through, of liquid, powder, and/or other ingredients is one way for the mixing chain agitator 100 to mix and disperse ingredients during the mixing process within the container 117. Ingredients (e.g., liquid and powder) may flow through a division 112, but parts of the ingredients may contact and be dispersed in variable directions from the first crossbar 105, the second crossbar 109, or the shaped framework 104 of the link. Ingredients contacting a link in the mixing chain agitator 100 can break up aggregations of powder that are in the container 117 during the mixing process.

The plurality of links to the mixing chain agitator 100 work advantageously for mixing and dispersing ingredients through additional actions. The movement of each link affects the movement and motion of the other links in the plurality of links. One exemplary effect from the movement of each link may be the creation of crushing action when two links come together in an overlapping collision. Another exemplary effect from the movement of each link may be the creation of a grinding action subsequent to the crushing action. For example, when two of the links have come together through the crushing action, the mixing process may terminate the overlap by creating one or more forces that results in a first link from the crushing action moving a direction different from a second link from the crushing action while at least a portion of each link's respective shaped frameworks and/or crossbars remain in contact. The interlink between the first link and the second link may limit movement, but each link may move in a translational (or straight) direction, rotational (or twisting) direction, or a combination thereof where each link's respective shaped frameworks and/or crossbars that remain in contact grind (or rub) against each other. Another exemplary effect from the movement of each link may be the creation of a pulling action when one or more links begin to move in a direction due to the force of the mixing process that pulls one or more other links in the same direction through contact between the interlinked shaped frameworks of each link.

The mixing chain agitator 100 has an independence from the container that allows the agitator to access any volume or surface area of the container 117 that may have aggregation of liquid(s), powder(s), and/or other ingredient(s). The independence of the mixing chain agitator 100 allows it be removed from the container 117 for reuse in another container. The independence of the mixing chain agitator 100 also allows it be removed from the container 117 for cleaning. An advantage of the present disclosure is the interlinking of the links to the mixing chain agitator 100 is such that the links may be positioned to overlap one another for easier insertion into a dishwashing machine for cleaning. Another advantage of the present disclosure is there are embodiments that enable one or more of the plurality of links to be unlinked from one another, which can also ease cleaning for each link. Another advantage of the mixing chain agitator 100 is each individual link's generally flat shaped framework, as seen in the side views of FIGS. 3A and 4A, will reach into corners of a container 117, unlike an agitator that has a more spherical shape.

Using the mixing chain agitator 100 of the present disclosure is exemplified in reference to FIG. 5. A container 117 has a removable lid 118 with an embodiment of the mixing chain agitator 100 therein. Liquid may be combined with powder and/or other ingredients in the container 117. Powder(s) may initially form a pile on the top surface of the liquid. The other ingredient(s) may also float on the top surface of the liquid, settle to the bottom of the container 117, or be submersed within the liquid at another lower level of the container 117. The liquid, powder, and other ingredients may be mixed together using a shaking action.

Adding the mixing chain agitator 100 to the container 117 facilitates mixing the liquid, powder, and other ingredients. Mixing may be accomplished using a shaking force applied to the container 117 with the removable lid 118 secured atop the container 117 and closed so that none of the mixture escapes. The shaking force may take the form of rotating motions, circular motions, or other oscillations and/or random movement. The mixing chain agitator 100 may be directed to particular locations in the container 117 if powder or other ingredients are clumping or accumulating. Such directed application of the mixing chain agitator 100 can improve dispersion and mixing of the liquid, powder, and other ingredients. Movement and rotation of the mixing chain agitator 100 causes contact and impact with aggregations or clumps in the container 117. The contact and impact can apply one or more of the crushing action, grinding action, and pulling action to the aggregations or clumps to disperse the powder and/or other ingredients through currents of the liquid formed by the mixing action.

In some embodiments of the present disclosure, the removable lid 118 includes a drinking orifice for a user to consume the liquid mixture after the mixing action is complete. The drinking orifice may be configured such that a user can drink directly from the removable lid 118 or using a straw (or other device) to drink from the container 117. As a preferred embodiment, the removable lid 118 is configured to prevent the mixing chain agitator 100 from falling out or being ingested while a user drinks from the container 117.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It is believed that the present disclosure and many of its attendant advantages will be understood by the foregoing description. It is also believed that it will be apparent that various changes may be made in the form, construction and arrangement of the modules and components thereof without departing from the scope and spirit of the disclosure or without sacrificing all of its material advantages. The form herein before described being merely an explanatory embodiment thereof, it is the intention of the following claims to encompass and include such changes.

What is claimed:

1. An independent agitator for mixing a plurality of ingredients, the independent agitator comprising:

a chain with a plurality of links, where:

the chain is a sequence of the plurality of links;

each link has a circular shaped framework comprising a first crossbar from a first bend on the shaped framework and a second crossbar from a second bend, where the first crossbar traverses a diameter of the link, the second crossbar traverses the diameter of the link, and the first crossbar and the second crossbar intersect at a center of the link; and at least one division where the link interlinks with at least another of the plurality of links, the division being defined by the intersecting of the first crossbar and the second crossbar and by one or more of outer edges;

each link has a top segment overlapping a bottom segment by a circumferential length and width; and each link is a single piece of low-corrosion metal.

2. The independent agitator of claim 1, wherein the plurality of links are a group of three links.

3. The independent agitator of claim 1, wherein the independent agitator is insertable within and removable from a variety of handheld containers with an enclosable mixing space for the plurality of ingredients.

* * * * *